United States Patent [19]

Gladish

[11] Patent Number: 5,005,778

[45] Date of Patent: Apr. 9, 1991

[54] WEB WINDING APPARATUS

[75] Inventor: Herbert E. Gladish, Ottawa, Canada

[73] Assignee: E. B. Eddy Forest Products Ltd., Ottawa, Canada

[21] Appl. No.: 442,520

[22] Filed: Nov. 28, 1989

[51] Int. Cl.[5] ..... B65H 75/06; B65H 18/08

[52] U.S. Cl. ..... 242/61; 242/67.10 R

[58] Field of Search ..... 242/61, 7.01, 7.19, 242/55, 62, 67.1, 65, 66, 75, 75.3, 186, 187, 191; 226/186, 195, 190; 384/300

[56] References Cited

U.S. PATENT DOCUMENTS

| | | | |
|---|---|---|---|
| 3,438,100 | 4/1969 | Moore | 226/190 |
| 3,622,059 | 11/1971 | Savela | 226/190 |
| 3,636,825 | 1/1972 | Randall et al. | 226/195 X |
| 3,790,056 | 7/1974 | Schmidt et al. . | |
| 3,989,201 | 11/1976 | Cottrell | 242/65 X |
| 4,802,430 | 2/1989 | Kramer | 384/300 X |
| 4,838,169 | 11/1989 | Gladish . | |

FOREIGN PATENT DOCUMENTS

| | | | |
|---|---|---|---|
| 742978 | 9/1966 | Canada | 242/65 |
| 950853 | 8/1974 | Canada . | |
| 1066645 | 3/1979 | Canada . | |
| 1167797 | 5/1984 | Canada . | |

*Primary Examiner*—Daniel P. Stodola
*Assistant Examiner*—John P. Darling
*Attorney, Agent, or Firm*—Jones, Tullar & Cooper

[57] ABSTRACT

Apparatus for wrapping web material about an elongated object, particularly one which is asymmetrical to a rotational axis thereof, includes a frame, a cylindrical support member mounted in the frame and an annular resilient sleeve loosely surrounding the support member longitudinally thereof. The object is mounted so that it creates a nip with the sleeve and the web material is fed into the nip. The object is rotated on its rotation axis to draw the web material through the nip and to wrap the material on the object. As the object rotates the sleeve will also rotate on the support member and it will deform radially to conform to the object as material is wrapped thereon. The deformation and almost instant changes in angular velocity of the sleeve reduces tension variations in the web material and result in a uniform covering of the object as it is wrapped.

17 Claims, 5 Drawing Sheets

WEB WINDING APPARATUS

This invention relates to the winding wrapping of web material on elongated objects, particularly objects having a non-circular cross-section relative to a longitudinal axis of the object.

BACKGROUND OF THE INVENTION

There is often a need to wrap elongated objects with a web material. For example, elongated hollow cylindrical cores are wrapped with cellulosic web material of limited crepe to create rolls of toilet tissue or paper towels. Other cores might be wrapped with plastic film to create rolls of cling wrap. In such cases the core, and the resulting wrapped roll can be considered as being symmetrical, as the core (or the object being wrapped) has essentially a circular cross-section relative to the central longitudinal axis of the core.

There is also a need to wrap elongated objects which might be considered as being transversely asymmetrical in that such objects have a non-circular cross-section relative to a longitudinal axis thereof. Statues, lamp bases and other such objects, for example, may have to be wrapped in web material to protect such objects during handling, storage or shipping.

U.S. Pat. No. 4,838,169 of June 13, 1989 teaches an asymmetrical runner for a SAILRAIL (trade mark) air conveyor system wherein the core of the runner has generally a D-shaped cross-section. That core must be wound or wrapped with a continuous length of extensible cellulosic web material to a thickness of about 2.5 cm. It is desirable that the web material be wound on the core with uniform tension and this is difficult to do, due in part to the non-circular cross-section of the core. Although the core may rotate at a constant angular velocity, the instantaneous velocity of the wrapped core at the point thereon where it contacts the web material will differ peripherally due to variations in the distance of such point to the axis of core rotation. This in turn causes increases and decreases in web velocity or acceleration at the core periphery and in wound web tension about an average value and such differences in velocity and tension can cause web breakage during winding or can affect the degree of compressibility (hardness) of the wound web material and hence the performance of a runner using the wound core. It is therefore desirable to provide apparatus which will compensate for the differences in web velocity and tension which occur when wrapping a web material on an object, particularly an object which is noncircular with respect to a rotation axis thereof.

SUMMARY OF THE INVENTION

The present invention overcomes the problems identified above by providing apparatus which compensates for the variations in instantaneous angular velocity or acceleration at the "wrapping point" and hence minimizes variations in wound web tension or hardness during the wrapping process. The "wrapping point" is considered to be the point at which the web material contacts the object being wrapped (on the first layer) or the point at which the web material contacts the layer of web material previously wound on the object.

The apparatus of the invention includes a cylindrical, non-rotatable support member located generally horizontally in a stationary frame. The support member will be longer than the object to be wrapped. A resilient annular sleeve member loosely surrounds the support member over the length thereof and has an inner diameter that is greater than the outer diameter of the support member. With the sleeve member resting on the support member there will be contact between the members at the top of the support member and there will be a gap between the members at the bottom of the support member. The sleeve member will be freely rotatable on the support member.

The object to be wrapped is removably mounted in the frame for rotation in such a manner that the outer surface thereof will contact the sleeve member during rotation, creating a nip along a line of contact between the object and the sleeve member. Preferably the object is loaded against the sleeve member, as by pneumatic or hydraulic cylinder means.

The web material is fed into the nip under substantially uniform tension and the object is rotated on the rotation axis thereof to draw web material into the nip and to wrap such material about the object. As the object rotates the friction between the web material and the sleeve member will cause the sleeve member to rotate on the support member and, more importantly, the resilient sleeve member will deform radially inwardly at the nip due to surface variations of the object and nip loading of web material on the object. Such inward deformation, particularly with asymmetrical objects creates instantaneous or momentary acceleration changes in movement of the web at the object's periphery where it contacts the sleeve. This tends to create instantaneous or momentary changes in web tension and hardness of the wrapping. The sleeve member absorbs the acceleration changes and limits the tension variations transmitted back through the web material to the object being wrapped. Due to the resilience and low inertial effects of the sleeve member there is little change in tension in the wrapped web material at the wrapping point. The sleeve member minimizes the extremes which take place at the maximum rotation radius of the object and at the minimum rotation radius of the object.

Preferably, the object will be mounted in a pivotable sub-frame which in turn is mounted in the frame for limited pivoting movement about an axis. The sub-frame pivoting movement is fluid cylinder loaded and damped to thereby control or limit the contact pressure attainable at the nip. Also, if deemed necessary, the support member can be provided with a surface covering of a "frictionless" material, such as TEFLON (trade mark for polytetrafluoroethylene) to further limit the frictional drag effects of the apparatus on the tension of the wrapped material. Other wrapping enhancing devices can be utilized with the apparatus of the invention, including spreader bars, slip sheets or other means of limited inertial effect to transversely smooth the web material as it is wrapped so as to eliminate wrinkles therefrom.

It should also be noted that while the invention was developed to enhance the wrapping of asymmetrical objects it could also be used to enhance the wrapping of symmetrical objects, namely objects which are circular with respect to the rotation axis thereof.

Broadly speaking, therefore, the present invention may be considered as providing apparatus for wrapping web material about an object, comprising: frame means; cylindrical support means mounted horizontally in the frame means; annular resilient sleeve means longitudinally and loosely surrounding the support means, having an inner diameter greater than the outer diameter of the support means, and being rotatable on the support means; means for removably mounting the object in the frame means, with an outer surface of the object contacting the sleeve means, creating a nip therebetween; means for feeding the web material into the nip under substantially uniform tension and means for rotating the object on a rotational axis thereof to draw the web material through the nip and to wrap such material about the object as it rotates, such rotating and wrapping movement causing the sleeve means to rotate on the support means, and the sleeve means deforming radially inwardly at the nip under loading to enhance uniform wrapping of such web material on the object.

DESCRIPTION OF THE PREFERRED EMBODIMENT

The present invention arose out of a need to be able to uniformly wrap web material about an elongated asymmetrical object under tension with minimum hardness and tension variations due to velocity changes and inertial effects. The principles enunciated herein and the apparatus disclosed in relation thereto are not restricted, however, to the wrapping of such objects and it will be clear that symmetrical objects could be effectively wrapped in accordance with this invention.

Figure 1:
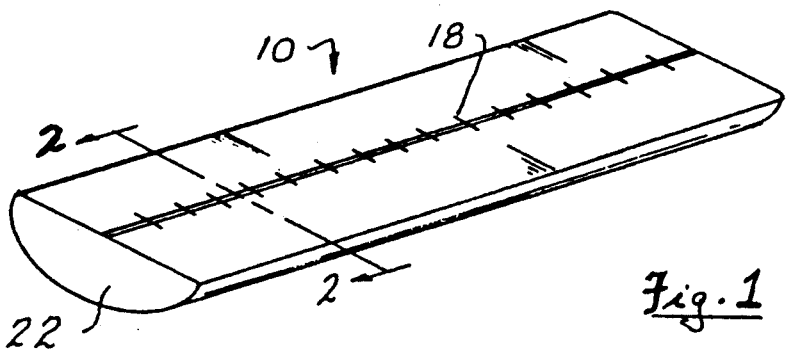
FIG. 1 shows in perspective a runner for a SAILRAIL (trade mark) air conveyor system for which this invention was created.
Figure 2:
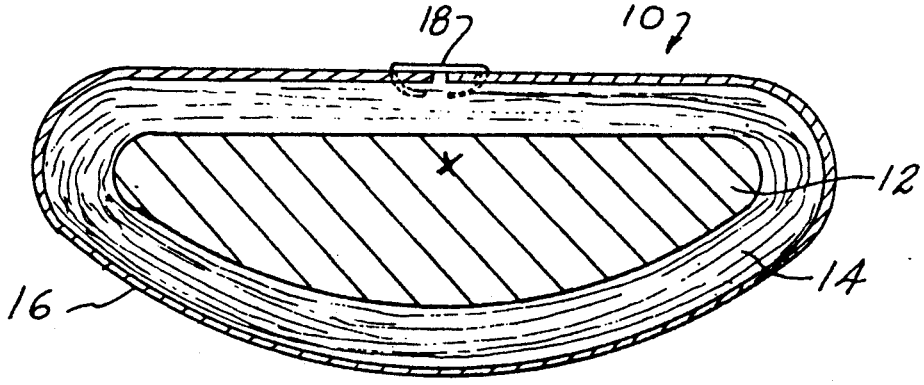
FIG. 2 shows a cross-section on the line 2—2 of the runner of FIG. 1.

FIGS. 1 and 2 illustrate the object in association with which the present invention was developed. That object is a runner 10 for use with a SAILRAIL (trade mark) air conveyor system. Reference may be had to commonly owned Canadian Patents 950,853 of July 9, 1974; 1,066,645 of Nov. 20, 1979; and 1,167,797 of May 2, 1984 and to U.S. Pat. No. 4,838,169 of June 13, 1989 for further information respecting such systems and the runner 10.

For the purposes of this invention it is sufficient to point out that the runner 10 includes a generally D-shaped elongated core 12, a layer 14 of compressible resilient web material wound or wrapped about the core 12 to a depth of about 2.5 cm, and a thin covering layer 16 fully enclosing the layer 14. The layer 16 is wrapped about the layer 14 with adjacent longitudinal edges 18 held close together by staples 20 which extend through the layers 16 and 14. The ends of the runner may be covered by caps 22 (only one being shown) attached in a suitable manner to covering layer 16. Typically, the core 12 is formed from wood with a width of about 10 cm, a maximum depth of about 4 cm and a length of about 120 cm. The web material may be a creped cellulosic material wound continuously onto the core to the desired thickness. The cover layer 16 may be a sheet of a resilient, smooth plastics material such as high density polyethylene. The thickness of layer 16 will be sufficient to protect the layer 14 during operation while permitting a desired degree of flexibility and compliance as required by the SAILRAIL concept.

It is clear from FIG. 2 that the cross-section of core 12 is non-circular with respect to a rotation axis identified by the "X" in FIG. 2. The core 12 is symmetrical about a vertical line passing through the axis but it is asymmetrical about a horizontal line passing therethrough. From the standpoint of wrapping web material onto the core 12 the core is considered to be asymmetrical. The varying distances of the "wrapping point" (previously defined) from the rotation axis make it very difficult to accurately control the tension and hardness of the wrapped material about the periphery of the core and this can lead to operational problems with winding of the core. The amount of tension in the web material determines the degree of compressibility or hardness thereof and that can be quite important, given the small gap of 1 mm or so between the outer surface of the layer 16 and the adjacent surface of the adjacent conveyor rail during operation.

Figure 3:
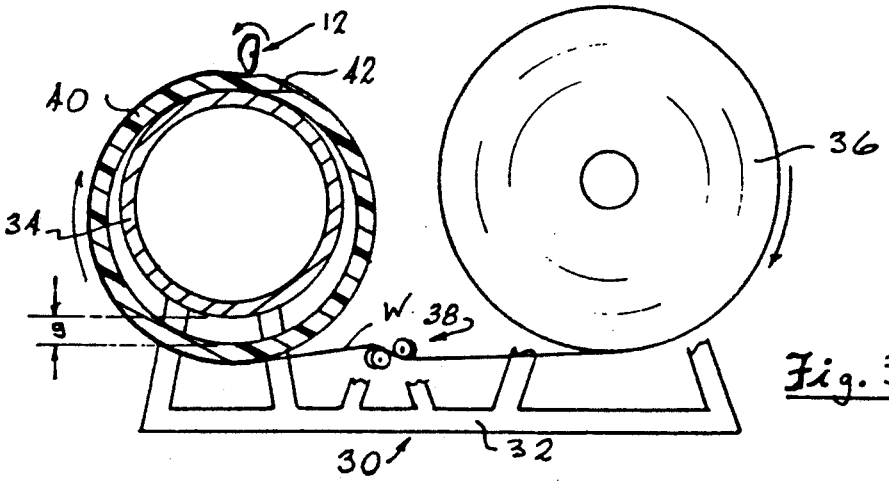
FIG. 3 shows schematically in longitudinal cross-section the basic components of the apparatus according to this invention.

The present invention provides apparatus, shown schematically in FIG. 3, which is intended to better control the tension and the hardness of the web material wrapped on the core 12. The apparatus, shown generally by the reference number 30, includes a frame 32 mounting a cylindrical support member 34 at one end thereof. Member 34 is preferably hollow as shown or it may be solid if desired. At the other end thereof the frame 32 mounts for rotation therein an elongated roll 36 of web material W to be wrapped onto a core 12. In accordance with usual web material feeding practice the frame 32 also mounts a pair of curved spreader bars 38 about which the web material W is fed after leaving the roll 36. The bars 38 are adjustable to spread the web material W to minimize wrinkling and to keep the material under substantially uniform tension but they are not sufficient to accurately control tension in the web during wrapping on an asymmetrical object. The mounting of roll 36 and bars 38 is conventional and does not form a part of the present invention. The cylindrical support member 3 is longitudinally loosely surrounded by an annular sleeve member 40 formed from a resilient material such as a medium to high density foam material having a thickness in the order of 10 cm. The foam sleeve member 40 is formed to have a longitudinal joint 42 extending essentially tangentially to the surface of the support member 34 so as to increase the strength of the joint and also so as to avoid a sharp line of density higher than the adjacent foam, which could affect the tension of web material wrapped onto the core. The support member 34 may have end guides, not shown, to retain the sleeve member longitudinally thereon.

The inner diameter of the annular sleeve 40 is greater than the outer diameter of the support cylinder 34 so that with the sleeve member in place, as seen in FIG. 3 there will be a gap g at the bottom between the cylinder 34 and the sleeve 40. For a cylinder 34 having a diameter of 40 to 45 cm the sleeve 40 should be dimensioned to achieve a gap g in the order of 2.5 to 5 cm.

The sleeve member 40 has very little rotational inertia and is freely rotatable on the outer surface of the support cylinder 34. If desired the surface of cylinder 34 can be coated or covered with a loose sheath of slippery material such as polyethylene or TEFLON (trade mark) to enhance the rotatability of the sleeve member on the support member.

The frame 32 includes a portion 44 at each end of the cylindrical support 34 that is intended to support or mount the core 12 (or other object to be wrapped) so that the outer surface thereof will be in contact with the outer surface of the sleeve member 40. In the preferred embodiment a sub-frame 46 is pivotally attached to the frame portion 44 as at 48. A drive shaft 50 extends between the sub-frames 46 and is bearingly supported on the pivot axis of each sub-frame 46 with respect to the frame portion 44. An extension 52 of the shaft 50 is drivingly connected to a motor 54, which motor is preferably driven by air under pressure for high torque, slow start and low inertial variable speed capabilities.

The shaft 50 carries a drive sprocket or pulley 60 at each end thereof adjacent the sub-frame 46 and a stub shaft 58 is bearingly supported at the free end of the sub-frame 46. Each stub shaft 58 mounts a driven sprocket or pulley 56 and the pairs of sprockets (or pulleys) 56,60 are connected by a continuous chain (or belt) 62. Each stub shaft has chuck means (not shown) for connection to an end of a core 12 (or other object to be wrapped). Operation of the motor 54 will cause rotation of the stub shafts 58 through the shaft extension 52, the shaft 50, the drive sprockets (or pulleys) 60, the chains (or belts) 62 and the driven sprockets (or pulleys) 56. When a core 12 is mounted to the stub shafts 58 it will rotate in the same direction as the shaft 50 at a variable angular velocity, as driven by the motor 54.

In order to vary the hardness of the wrapping as well as to prevent or reduce bouncing of the sub-frames 46 as the asymmetrical core rotates there is provided a loading means for each sub-frame. In the illustrated embodiment a pneumatic (or hydraulic) fluid cylinder absorber mechanism 64 is attached to the sub-frame 46 and to an extension 66 of the frame portion 44. The mechanism 64 is preferably in the form of a piston and cylinder arrangement and, preferably, there should be an appropriate means for adjusting the loading forces available therewith. The mechanism 64 may also be provided with damping means in a conventional manner, or even separate damping means could be provided, if desired.

Figure 5B:
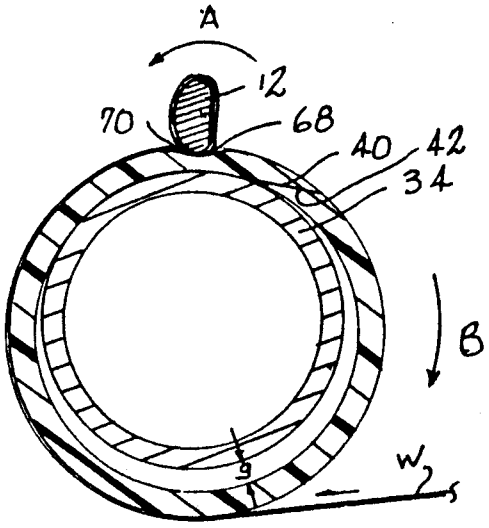
FIGS. 5A, 5B and 5C show the interaction between the resilient sleeve and the object being wrapped during the wrapping process.
Figure 5C:
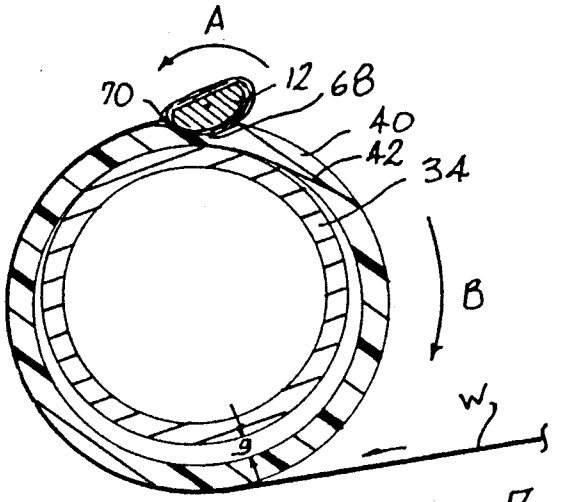
Figure 5A:
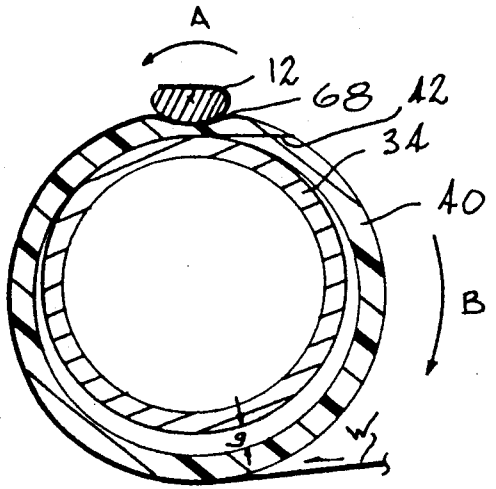

FIGS. 5A, 5B and 5C illustrate the interaction among the core 12, the web W and the sleeve 40 during the wrapping process. With initial reference to FIG. 5A it will be seen that the core 12 is mounted so that its outer surface is in loaded contact with the sleeve 40 so as to create a nip 68 along the line of contact. The web W is wound around a portion of the sleeve 40 and is fed into the nip 68 and attached to the surface of the core 12 by a single starting wrap, adhesive tape, an adhesive or staples. Then the core is rotated on its rotation axis in the direction of the upper arrow A, causing the web to feed through the nip 68 and thereby causing rotation of the sleeve 40 on the support member 34 in the direction of the arrow B. As the core rotates the sleeve will be laterally displaced on the support member due to the loading and pull exerted by the core and the web material and the maximum gap will be moved to the right as in FIGS. 5A, 5B, and 5C.

In FIG. 5B the core has rotated so that the surface portion at a maximum distance from the rotation axis is at the nip 68. This action compresses the rotating sleeve 40 in the area of the nip, creating a depression 70 therein along the nip. The compression effect also varies the peripheral velocity of the sleeve 40 with little inertia effect, and the compliance of the sleeve minimizes the instantaneous velocity change, thus minimizing the variations in the tension in the web W in the area where, otherwise, there would be an increase in tension over the average tension of the wound web.

FIG. 5C shows the core with most of the web material wound thereon. The depression 70 is not substantially greater than that shown in FIG. 5B since the outward force due to the reaction of the foam sleeve to compression acts on the loading mechanisms 64 to permit the sub-frames 46 and the wound core to move slightly radially outwardly of the sleeve.

In order to enhance smooth wrapping of the web material the apparatus of this invention can incorporate one or more means to remove wrinkles from the web material. For example, FIG. 6A shows the foam sleeve **40*a*, in a somewhat exaggerated manner, as being slightly thicker at the centre 72 than at the ends in the fashion of a "crowned" roll as used in paper making. The crowning effect would be obtained with a smoothly curved outer surface of the sleeve 40A from end to end. The crowned sleeve 40A causes the web material to stretch laterally from the line of initial contact through to the nip 68** to thereby remove wrinkles therefrom.

Figure 6B:
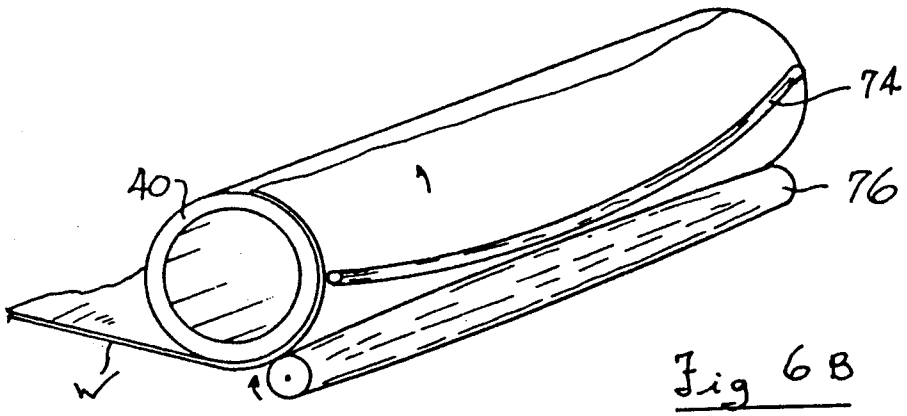
FIGS. 6A, 6B and 6C illustrate schematically several means for removing wrinkles from the web material.
Figure 6A:
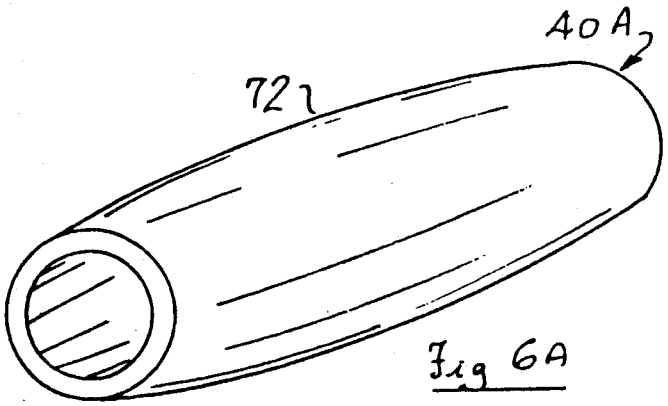

FIG. 6B shows two alternative wrinkle-removing mechanisms. The first is a generally bent spreader bar 74 mounted so as to displace the web material, pushing it against the sleeve 40, so as to move wrinkles towards the lateral edges of the web W. As an alternative, the spreader bar 74 can be used in conjunction with a crowned foam roll 76 which also pushes the web W against the sleeve 40.

Figure 6C:
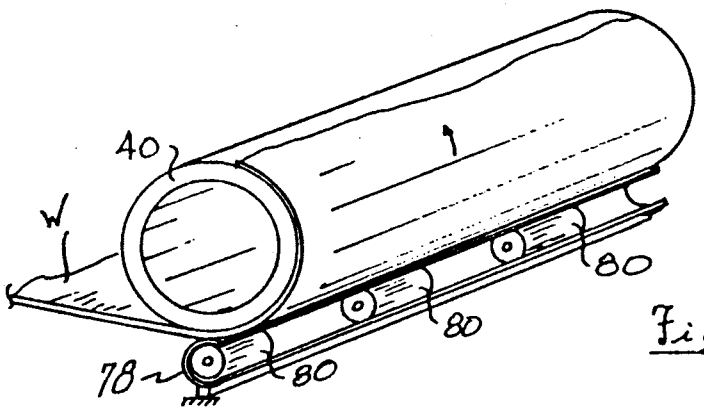

FIG. 6C shows a slip sheet 78 mounted below the sleeve member 40 and exerting a transverse load on the web N. The slip sheet may be a length of flexible plastic material bent into a C-shape and extending transversely of the sleeve member. One longitudinal edge of the slip sheet is fixed within the frame 32 and the upper, free edge will bear resiliently against the web material as it passes thereby. The slip sheet thus helps to remove wrinkles from the web material as it passes around the sleeve member. Short lengths of tissue rolls 80 may be placed within the confines of the slip sheet to locally increase the pressure exerted by the slip sheet if desired.

Figure 4:
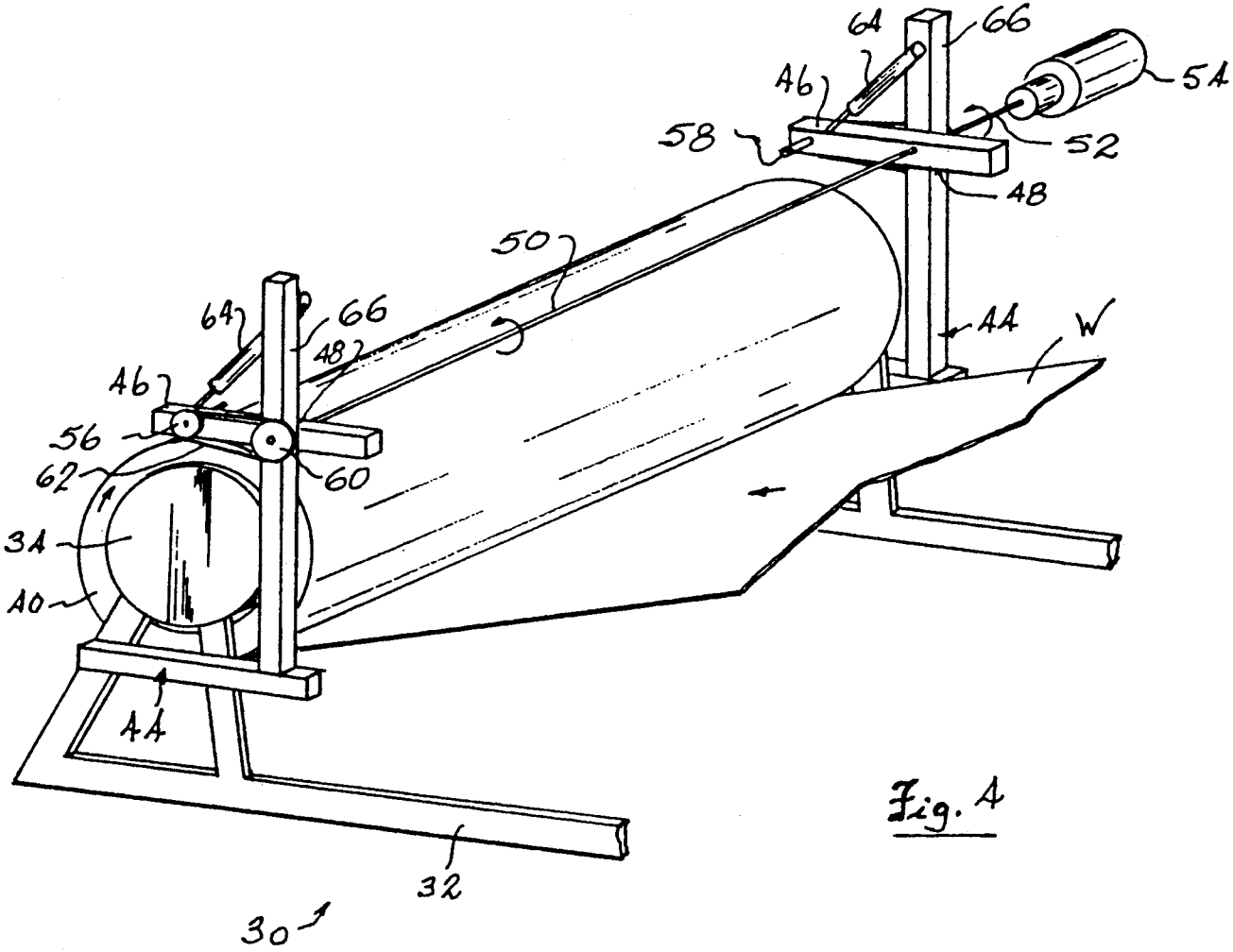
FIG. 4 shows a perspective view of a portion of the schematic representation of the apparatus of FIG. 3.
Figure 7:
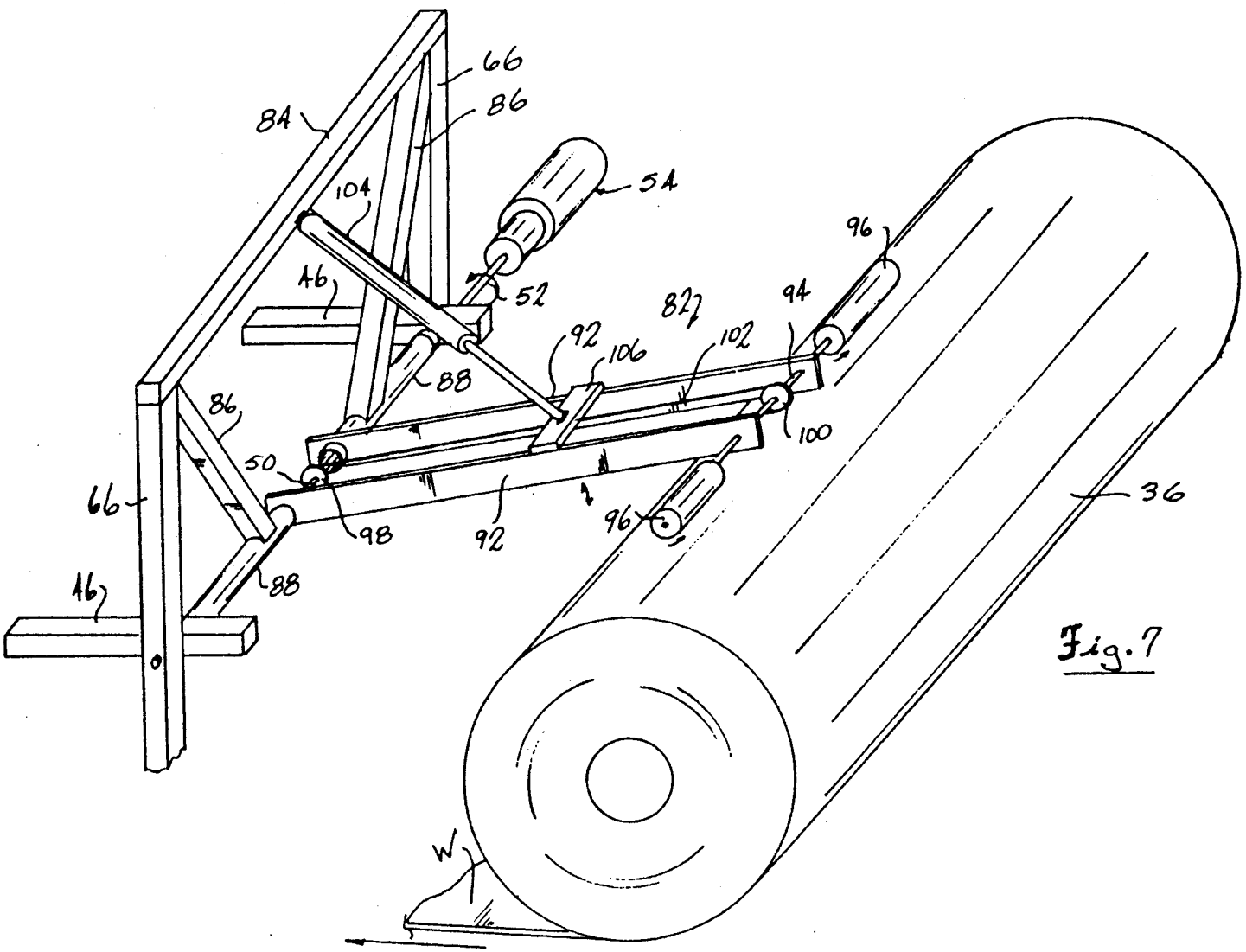
FIG. 7 illustrates schematically a drive means for the source roll.

FIG. 7 is a view similar to FIG. 4 showing a mechanism 82 which can be used to drive the source roll 36 generally in synchronism with the core 12. Normally the source roll would not be driven but large rolls possess considerable inertia and should there be a break in the web W a large amount of material could unwrap from the source roll before it stops. The mechanism 82 would drive the roll 36 to reduce the average pull thereon exerted by the rotating core 12 and it would also serve as a brake, stopping roll rotation when the core 12 stops rotating.

The mechanism 82 is provided in the frame 32 and in the illustrated embodiment there is a reinforcing framework including cross-bar 84 connecting the extensions 66, angled members 86 and cylindrical hollow tube members 88 surrounding the shaft 50 and extending therealong from respective extensions 66. The sub-frames 46 pivot on the tube members 88 as desired.

There is a gap between the inner ends of the tube members 88, exposing the shaft 50. Arm means, shown as a pair of rails 92 is pivotally supported on tube members 88. The rails extend outwardly so that the outer ends thereof overly the source roll 36. A shaft 94 is rotatably supported by the rails 92 at the outer ends thereof, each lateral end of the shaft 94 mounting a foam or rubber roll 96, which rolls will continue to contact the web material on the source roll 36 as it reduces in diameter.

Shaft 50 carries a sprocket 98 between rails 92 and shaft 94 carries a similar sprocket 100 between the outer ends of rails 92. A chain 102 is entrained about the sprockets 98,102 that sprocket 100 will rotate in the same direction as sprocket 98. As the shaft 50 is driven by motor 54 the sprocket 98 will transmit rotative forces to the rolls 96 via chain 102 and sprocket 100 so that the rolls 96 will in turn peripherally drive the source roll 36.

The rolls 96 can be made to bear on the source roll 36 with a controlled loading by utilizing a pneumatic or hydraulic piston and cylinder member 104 connected at one end to the crossbar 84 and at the other end to the rails 92 via a crossbrace 106.

Whenever the motor 54 stops, the rolls 96 will also stop rotating and will apply braking forces to the source roll 36, bringing it to a halt much faster than would occur without the mechanism 82.

The present invention can be seen as providing an improved apparatus for winding or wrapping elongated objects, whether they be symmetrical or asymmetrical relative to a rotational axis thereof. The apparatus of the invention could be altered in form by a person skilled in the art so as to meet specific requirements, but without departing from the spirit of the invention. Accordingly, the protection to be afforded the invention is to be determined from the scope of the claims appended hereto.

THE EMBODIMENTS OF THE INVENTION IN WHICH AN EXCLUSIVE PROPERTY OR PRIVILEGE IS CLAIMED ARE DEFINED AS FOLLOWS:

1. Apparatus for wrapping web material about an object, comprising:

(a) frame means;

(b) cylindrical support means mounted horizontally in said frame means;

(c) annular resilient sleeve means longitudinally and loosely surrounding said support means, having an inner diameter greater than the outer diameter of said support means, and being rotatable on and with respect to said support means;

(d) means for removably mounting an object in said frame means, with an outer surface of said object contacting said sleeve means, creating a nip therebetween;

(e) means for feeding said web material into said nip under substantially uniform tension; and (f) means for rotating said object on a rotation axis thereof to draw said web material through said nip and to wrap such material about said object as it rotates, such rotating and wrapping movement causing said sleeve means to rotate on and with respect to said support means, and said sleeve means deforming radially inwardly at said nip under loading to enhance uniform wrapping of such web material on said object.

2. Apparatus according to claim 1 wherein said object mounting means includes sub-frame means pivotally connected to said frame means, loading means connected to said sub-frame means for controlling contact pressure between the object as it is wrapped and said sleeve means, and drive means within said sub-frame means to which said object is removably mountable.

3. Apparatus according to claim 2 wherein said rotating means comprises a drive motor drivingly connected to said drive means and control means connected to said drive motor for controlling drive variables including motor speed and torque applied to said drive means.

4. Apparatus according to claim 3 wherein said drive motor is drivingly connected to said drive means by way of a drive shaft extending parallel to said support means along a pivot axis of said sub-frame means relative to said frame means, means connecting said shaft to said drive motor, first sprocket means at each end of said shaft, second sprocket means connected to said drive means, and drive chain means connecting each first sprocket means to a corresponding second sprocket means.

5. Apparatus according to claim 4 wherein said web material is provided on a source roll thereof mounted for rotation in said frame means, and including a drive mechanism for said source roll, said drive mechanism including arm means pivotally mounted at one end on tube members covering said drive shaft and extending so as to overly the source roll at the other end thereof, an outer shaft rotatably supported at the outer end of the arm means and extending laterally thereof, a cylindrical drive roll secured to each extended end of said outer shaft, a first sprocket attached to said drive shaft, a second sprocket attached to said outer shaft, a drive chain extending between and entrained about said sprockets, and loading means for applying a force biasing said cylindrical drive rolls into contact with the source roll.

6. Apparatus according to claim 3 wherein said loading means and said drive motor are pneumatically operated.

7. Apparatus according to claim 3 wherein said sleeve means comprises an annular foam member having a thickness of about 10 cm.

8. Apparatus according to claim 7 wherein said sleeve means is slightly crowned intermediate the ends thereof to laterally tension the web material and thereby remove wrinkles therefrom.

9. Apparatus according to claim 7 including a resilient, elongated slip sheet, of C-shape in cross-section, mounted with one longitudinal edge thereof fixed in said frame means and the other longitudinal edge thereof being free to bear resiliently against the web material and thereby aid in removing wrinkles therefrom.

10. Apparatus according to claim 7 including a bar extending laterally adjacent said sleeve member so as to contact the web material and thereby aid in removing wrinkles therefrom, said bar being curved slightly in the direction of web travel.

11. Apparatus according to claim 10 including a crowned roll of foam material contacting the web material adjacent said bar.

12. Apparatus according to claim 1 including a thin annular sleeve of relatively frictionless material covering said support means to enhance rotatability of said sleeve means relative to said support means.

13. Apparatus for wrapping web material about an elongated object having a rotational axis and a non-circular cross-section relative to said axis, comprising:

(a) frame means;

(b) a cylindrical support member non-rotatably mounted horizontally in said frame means;

(c) an annular sleeve member of resilient foam material longitudinally and loosely surrounding said support member, having an inner diameter greater than the outer diameter said support member, and being rotatable on and with respect to said support member;

(d) sub-frame means pivotally connected to said frame means;

(e) drive means in said sub-frame means to which an object is removably mountable so as to be in contact with said sleeve member, creating a nip therebetween;

(f) means for feeding said web material into said nip under substantially uniform tension; and (g) a drive motor drivingly connected to said drive means for rotating said object on said axis to draw said web material through said nip and to wrap such material about said object as it rotates, such rotating and wrapping movement causing said sleeve member to rotate on said support member, and said sleeve member deforming radially inwardly at said nip under loading to enhance uniform wrapping of such web material on said object.

14. Apparatus according to claim 13 including loading means connected to said sub-frame means for controlling contact pressure between the object as it is wrapped and said sleeve member.

15. Apparatus according to claim 14 wherein said drive motor is drivingly connected to said drive means by way of a drive shaft extending parallel to said support member along a pivot axis of said sub-frame means relative to said frame means, means connecting said shaft to said drive motor, first sprocket means at each end of said shaft, second sprocket means connected to said drive means, and drive chain means connecting each first sprocket means to a corresponding second sprocket means.

16. Apparatus according to claim 15 wherein said web material is provided on a source roll thereof mounted for rotation in said frame means, and including a drive mechanism for said source roll, said drive mechanism including arm means pivotally mounted at one end on tube members covering said drive shaft and extending so as to overly the source roll at the other end thereof, an outer shaft rotatably supported at the outer end of the arm means and extending laterally thereof, a cylindrical drive roll secured to each extended end of said outer shaft, a first sprocket attached to said drive shaft, a second sprocket attached to said outer shaft, a drive chain extending between and entrained about said sprockets, and loading means for applying a force biasing said cylindrical drive rolls into contact with the source roll.

17. Apparatus according to claim 15 including a resilient, elongated slip sheet, of C-shape in cross-section, mounted with one longitudinal edge thereof fixed in said frame means and the other longitudinal edge thereof being free to bear resiliently against the web material and thereby aid in removing wrinkles therefrom.

* * * * *